US008210626B2

(12) United States Patent
Shin et al.

(10) Patent No.: US 8,210,626 B2
(45) Date of Patent: Jul. 3, 2012

(54) ELEVATION ADJUSTMENT APPARATUS FOR SHELF IN REFRIGERATOR

(75) Inventors: Jeong-Ho Shin, Changwon (KR); Byeong-Gyu Kang, Changwon (KR); Jae-Youl Lee, Changwon (KR); Jong-Seok Yoon, Changwon (KR); Ki-Hoon Song, Changwon (KR)

(73) Assignee: LG Electronics Inc., Seoul (KR)

( * ) Notice: Subject to any disclaimer, the term of this patent is extended or adjusted under 35 U.S.C. 154(b) by 379 days.

(21) Appl. No.: 12/513,603

(22) PCT Filed: Nov. 14, 2007

(86) PCT No.: PCT/KR2007/005716

§ 371 (c)(1),
(2), (4) Date: May 5, 2009

(87) PCT Pub. No.: WO2008/062966

PCT Pub. Date: May 29, 2008

(65) Prior Publication Data

US 2010/0064721 A1 Mar. 18, 2010

(30) Foreign Application Priority Data

Nov. 20, 2006 (KR) ..... 10-2006-0114401

(51) Int. Cl.
*A47B 96/04* (2006.01)
*A47B 9/00* (2006.01)

(52) U.S. Cl. ..... 312/408; 108/108

(58) Field of Classification Search ..... 312/408, 312/404, 351, 319.1; 108/106–108, 147.11, 108/147.17, 109, 110, 147.14, 147.15, 147.12; 211/187, 151; 248/243, 244, 250, 295.11, 420, 188.2; 222/391
See application file for complete search history.

(56) References Cited

U.S. PATENT DOCUMENTS 464,918 A * 12/1891 Bacon ..... 312/31.2
(Continued)

FOREIGN PATENT DOCUMENTS

CN 2248266 Y 2/1997
(Continued)

OTHER PUBLICATIONS

U.S. Office Action for U.S. Appl. No. 12/515,508 mailed Feb. 3, 2012, 21 pages.*

(Continued)

*Primary Examiner* — Darnell Jayne
*Assistant Examiner* — Andrew Roersma
(74) *Attorney, Agent, or Firm* — Birch, Stewart, Kolasch & Birch, LLP.

(57) ABSTRACT

In order to allow a user to conveniently adjust the elevation of the shelf, simplify the structure not to generate noise, stably maintain the selected position of the shelf, and rapidly and considerably adjusting the elevation of the shelf, the present invention discloses an elevation adjustment apparatus for a shelf in a refrigerator comprises a shaft lengthily provided up and down in the inside of the refrigerator; a shelf moved up and down along the shaft; an operating lever hinged to the shelf and having a through hole through which the shaft penetrates; and an elastic member pushing the operating lever to contact the through hole to the shelf and hook them so that the up and down movement of the shelf is selectively restricted.

13 Claims, 6 Drawing Sheets

U.S. PATENT DOCUMENTS 766,605 A * 8/1904 Dilg ..... 248/246
2,002,339 A * 5/1935 Copeman ..... 62/381
2,051,969 A * 8/1936 Shastock ..... 403/105
2,784,603 A * 3/1957 Collins ..... 74/169
3,054,511 A 9/1962 Erismann
3,128,074 A 4/1964 Schwartz
3,316,044 A * 4/1967 Carbary ..... 312/408
3,337,283 A * 8/1967 Schlenkert ..... 312/306
3,356,328 A 12/1967 Sachau
3,437,060 A 4/1969 Giambalvo
3,601,432 A 8/1971 Fenwick et al.
3,726,581 A * 4/1973 Doepke ..... 312/351
3,730,108 A 5/1973 Stroh
3,848,844 A * 11/1974 Barrett ..... 248/245
3,885,846 A 5/1975 Chuang et al.
3,964,404 A * 6/1976 Mueller et al. ..... 108/147.14
4,056,196 A 11/1977 Brauning
4,156,515 A * 5/1979 Mochly ..... 248/246
4,299,368 A 11/1981 Winkler
4,901,965 A * 2/1990 Bowman ..... 248/246
5,151,072 A 9/1992 Cone et al.
5,199,778 A * 4/1993 Aoki et al. ..... 312/408
5,338,137 A * 8/1994 Jensen ..... 410/146
5,381,738 A * 1/1995 Meyer ..... 108/42
5,415,302 A 5/1995 Carlson et al.
5,483,902 A 1/1996 Grosch
5,531,167 A * 7/1996 Stevens et al. ..... 108/106
5,644,993 A * 7/1997 Dohnalik ..... 108/108
5,687,655 A 11/1997 Weinschenk, Jr. et al.
5,913,584 A 6/1999 Swindell et al.
6,017,009 A * 1/2000 Swartz et al. ..... 248/245
6,065,821 A 5/2000 Anderson et al.
6,105,794 A * 8/2000 Bauer ..... 211/94.01
6,113,042 A 9/2000 Welsch et al.
6,811,045 B1 * 11/2004 Masker et al. ..... 211/153
7,455,629 B2 11/2008 Abelbeck
2006/0013676 A1 * 1/2006 Oh et al. ..... 414/288
2007/0176528 A1 8/2007 Lee et al.

FOREIGN PATENT DOCUMENTS

FR 2850002 A1 7/2004
FR 2850002 A1 * 7/2004
KR 10-19970-11759 A 3/1997
KR 20-1997-0014663 U 4/1997
KR 20-1999-0009504 U 3/1999
KR 10-2004-0070000 A 8/2004
KR 10-2006-0106018 A 10/2006
WO WO 9113314 A1 * 9/1991

OTHER PUBLICATIONS

English Abstract for KR-1997-001759-A1.
English Abstract for KR-20-1997-0014663-U.
English Abstract for KR-20-1999-0009504-U.

* cited by examiner

[Fig. 1]
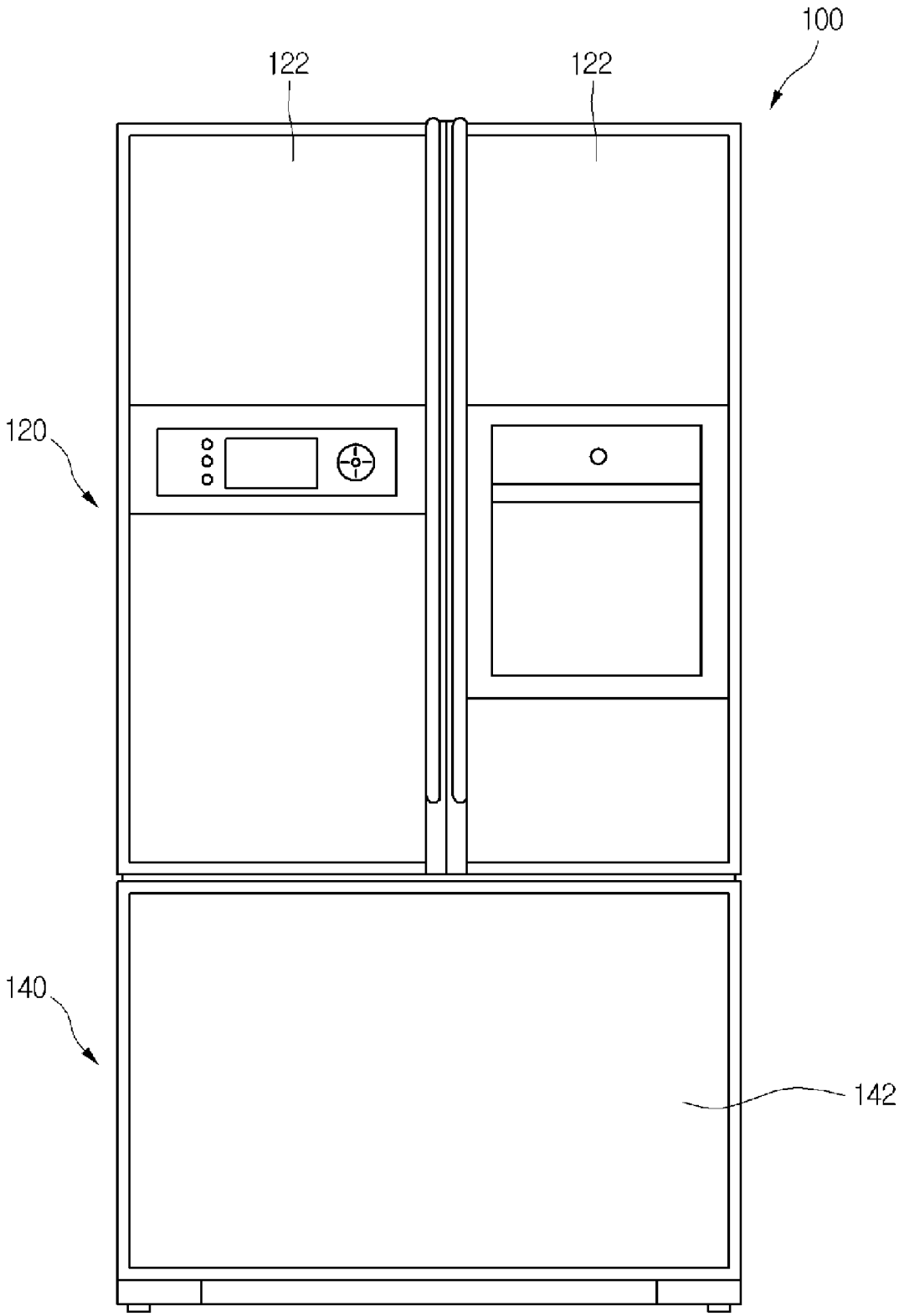

[Fig. 2]
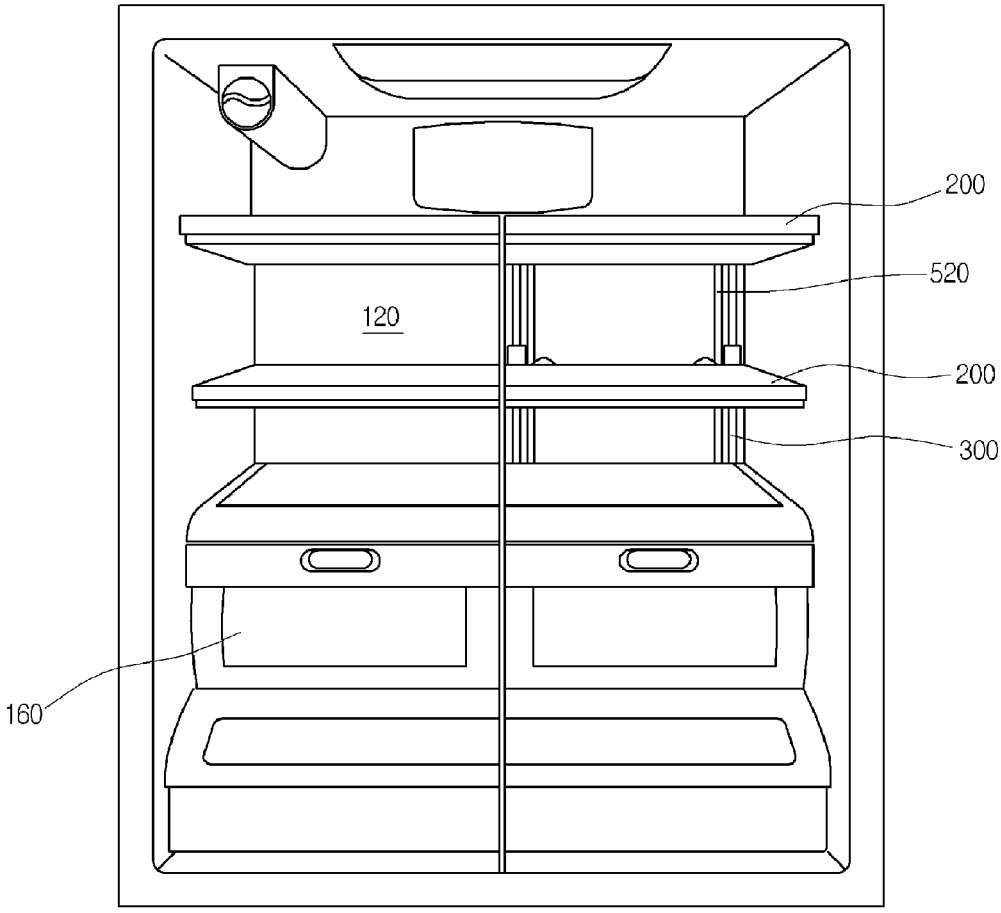
[Fig. 3]
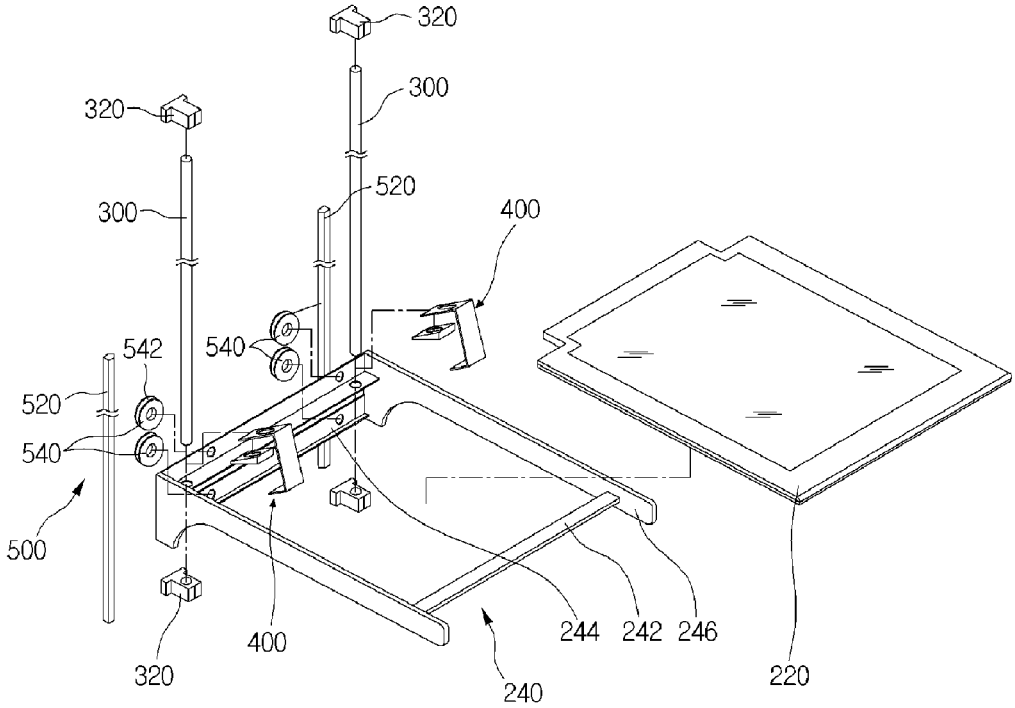

[Fig. 4]
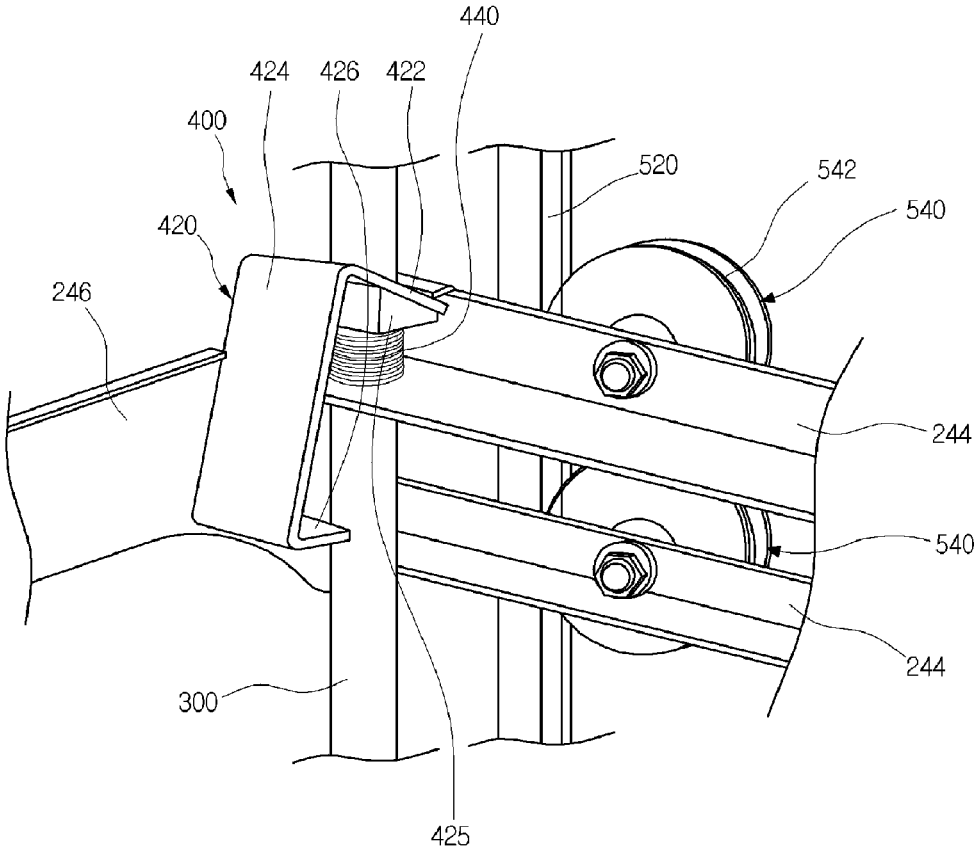
[Fig. 5]
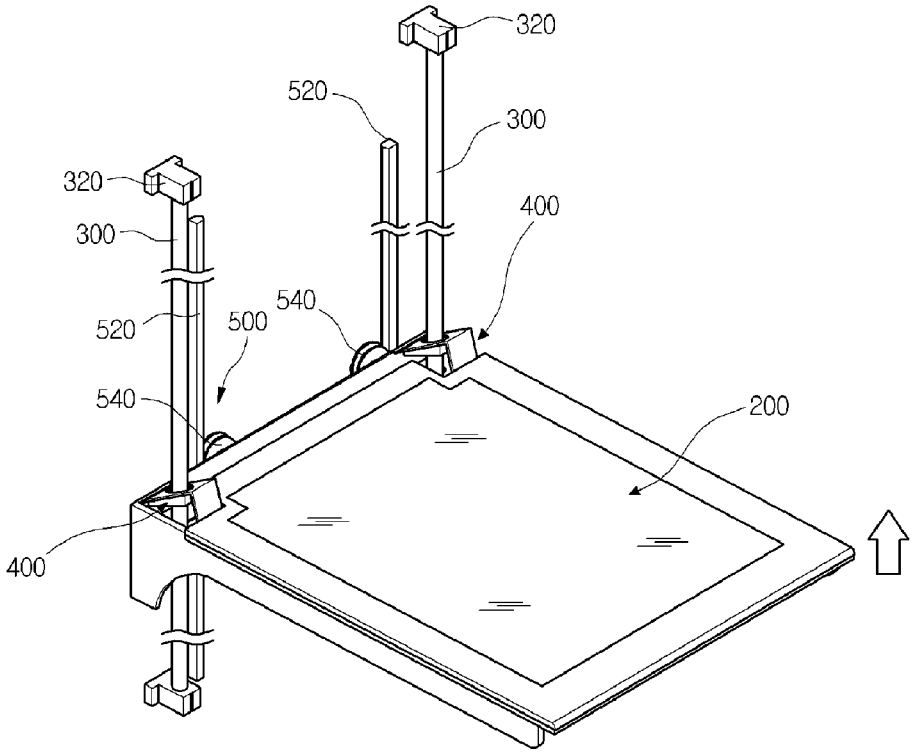

[Fig. 6]
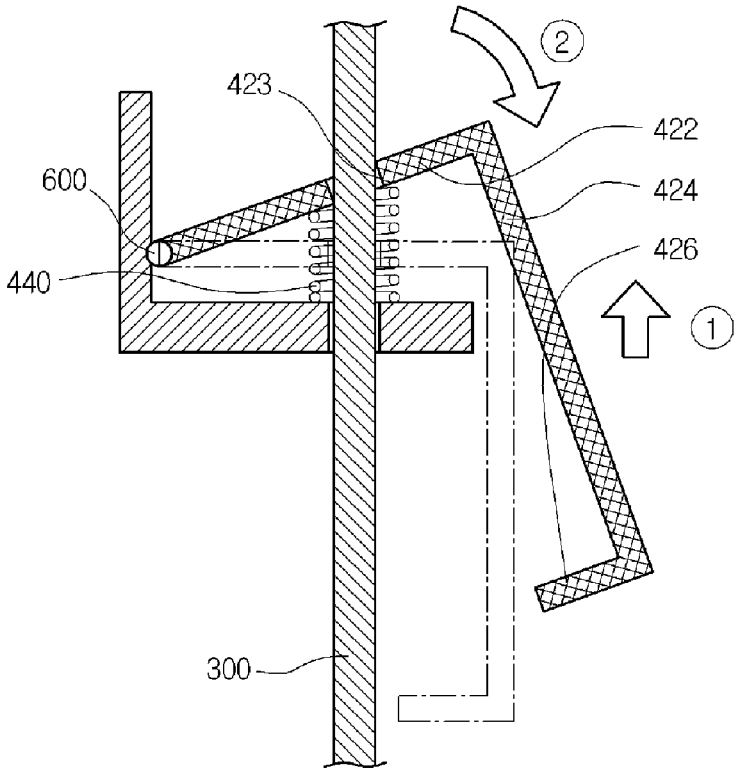
[Fig. 7]
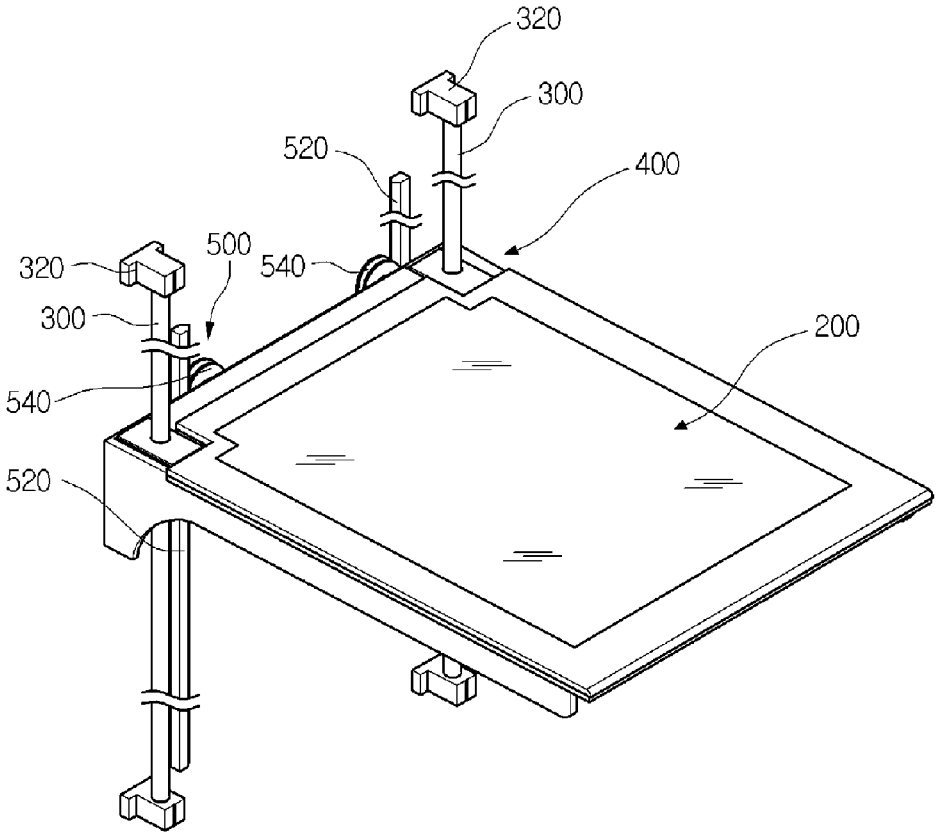

[Fig. 8]
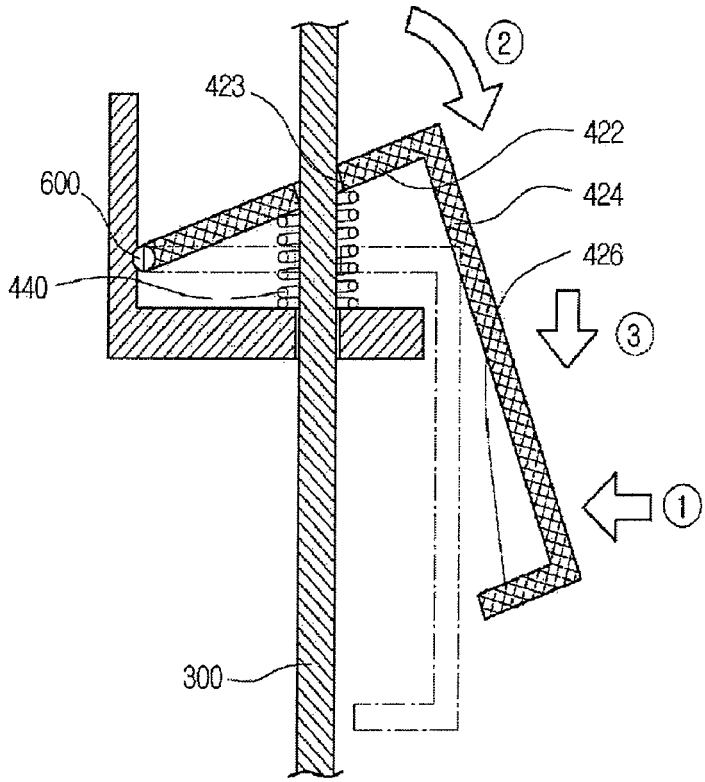
[Fig. 9]
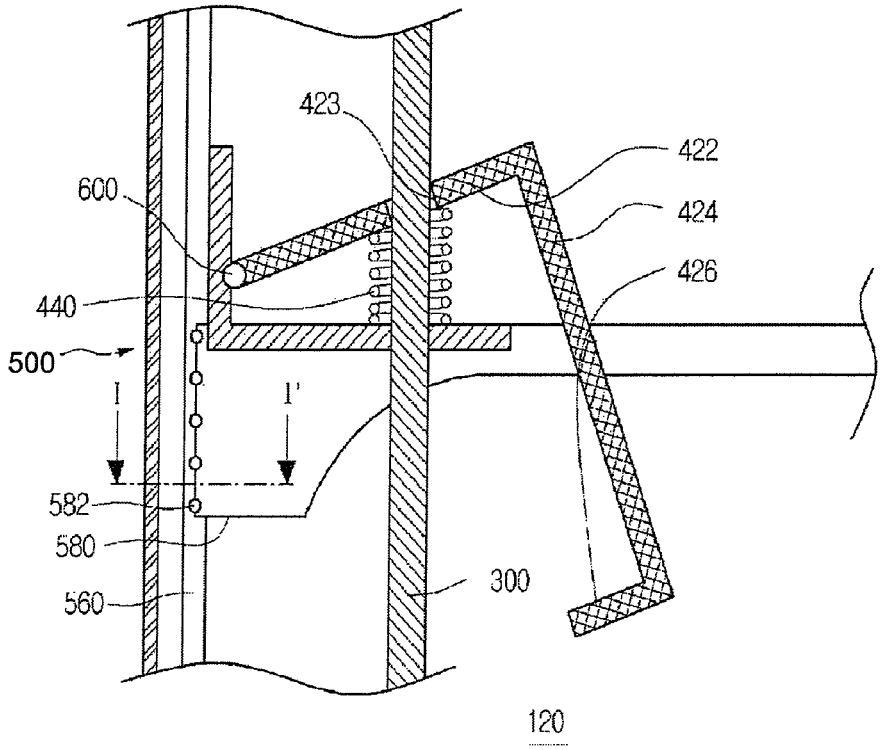

[Fig. 10]
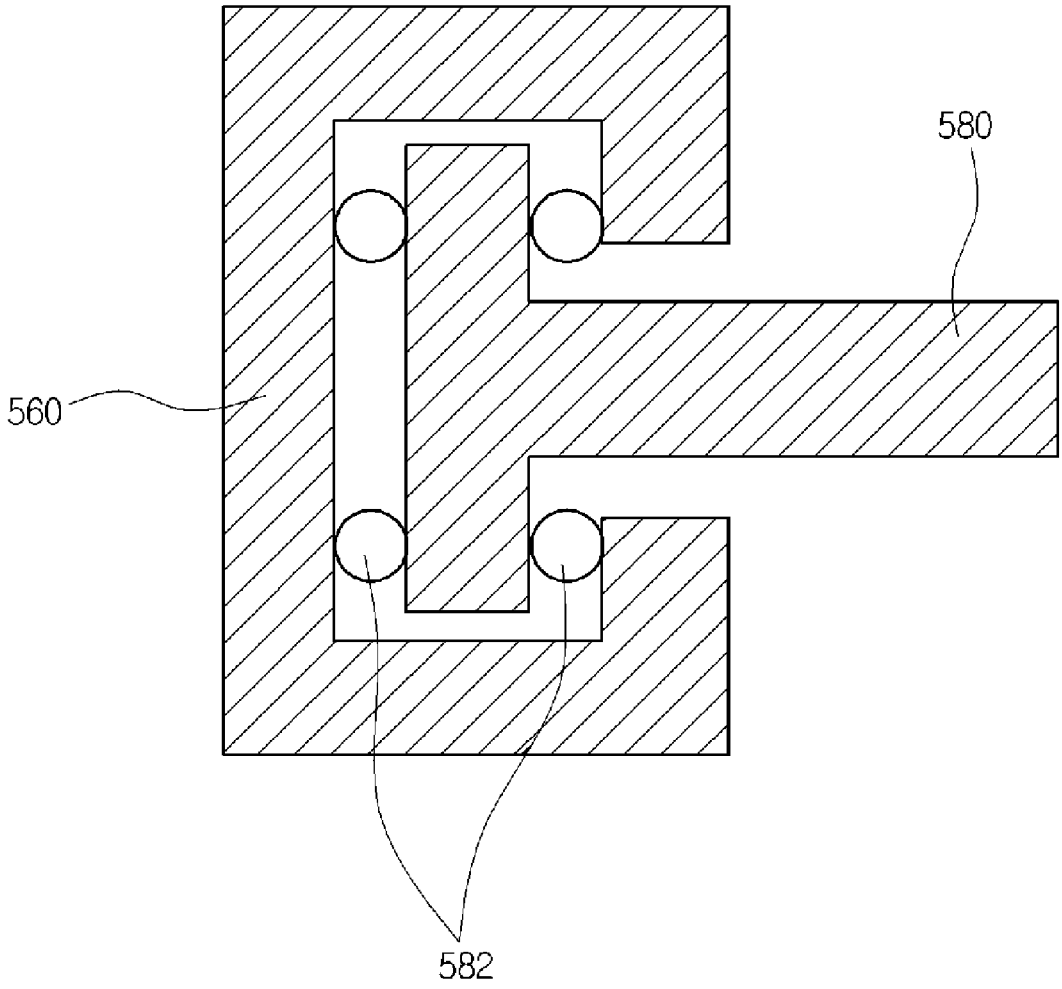

ELEVATION ADJUSTMENT APPARATUS FOR SHELF IN REFRIGERATOR

TECHNICAL FIELD

This document relates to a refrigerator, and to an elevation adjustment apparatus for a shelf in a refrigerator to move a shelf in the inside of the refrigerator up and down and stably maintain an elevation selected after the shelf is moved.

BACKGROUND ART

A refrigerator is an apparatus for storing foods at a low temperature and is for the frozen storage and refrigeration storage of foods according to the state of foods to be stored.

Cold air supplied to the inside of the refrigerator is generated by means of a heat exchanging action of refrigerant and is continuously supplied to the refrigerator by repeatedly performing a compression-condensation-expansion-evaporation cycle. The supplied refrigerant is uniformly transferred to the inside of the refrigerator by means of convection so that foods can be stored in the refrigerator at a desired temperature. Such a refrigerator shows a tendency to be bigger and multi-functional and takes various forms according to a form of a storage space.

Various foods to be stored in the refrigerating or freezing state are properly stored in a shelf, a drawer, a basket, or the like provided in the inside of the refrigerator. The drawer, shelf, basket, or the like partitions the inside of the refrigerator so that they can store foods with various sizes and storage conditions.

Meanwhile, the mount position of the shelf partitioning the inside of the refrigerator is changed so that the space form of the inside of the refrigerator can be changed. As a result, a user can form a proper space by adjusting the mount position of the shelf so as to receive foods with various sizes or a food container. The representative mount structure of such a shelf is a structure that forms molded ends on left and right wall surfaces of the inside of the refrigerator and places the shelf thereon. However, in such a structure, since the shelf can be mounted only on the position where the molded end is formed, there is any limitation in mounting the shelf as well as manufacturing cost is increased and the aesthetic sense of a design is degraded, due to the formation of many molded ends.

Meanwhile, as another mount structure of the shelf, there is a structure that mounts the shelf in a form such as a cantilever by mounting guide with a plurality of holes on a rear wall surface of the inside of the refrigerator and coupling the shelf with a coupling part in a ring shape with the holes of the guide.

However, even in such a structure, the shelf should be completely separated and then assembled again in order to change the mount position of the shelf. To this end, the user puts down all foods on the shelf and the assembles the shelf at a new position. Thereafter, the user puts all foods on the shelf again. Also, each time that the user mounts the shelf, he/she should properly balance its horizon, etc. Therefore, considerable inconvenience is caused in mounting the shelf.

In order to solve the problems, U.S. Pat. No. 6,065,821 discloses the shelf structure capable of adjusting the up and down elevations of the shelfs engaged by means of a gear coupling by turning a handle or a lever mounted to the shelf.

However, in such a conventional technology, since the handle should be continuously turned in order to adjust the elevation of the shelf, when the movement distance of the shelf is distant, the handle should be turned for a long time, causing the inconvenience of use. Further, when foods put on the shelf, the problems such as consuming more time and energy, etc., in operating the handle in order to move the shelf up due to their weight are caused. Also, since the components in a gear shape or a sprocket shape perform a relative movement, considerable noise is caused and when foods put on the shelf, the loud noise is caused so that sensibility dissatisfaction of a user is caused. Also, since its structure is complicated, it is difficult to separate and mount the shelf.

DISCLOSURE OF INVENTION

Technical Problem

It is an object of the present invention to provide an elevation adjustment apparatus for a shelf in a refrigerator that is convenient for a user operation by permitting a user to conveniently move a shelf to a considerable distance at a time, simplifying its operation, simplifying its separation and mount, and simplifying its constitution.

Technical Solution

An elevation adjustment apparatus of a shelf in a refrigerator according to the present invention comprises: a shaft lengthily provided up and down in the inside of the refrigerator; a shelf moved up and down along the shaft; an operating lever hinged to the shelf and having a through hole through which the shaft penetrates; and an elastic member pushing the operating lever to contact the through hole to the shelf and hook them so that the up and down movement of the shelf is selectively restricted.

An elevation adjustment apparatus of a shelf in a refrigerator according to the present invention comprises: a shelf provided in the inside of the refrigerator; a shaft lengthily provided up and down on one side wall of the inside of the refrigerator; a sliding guide lengthily provided up and down on the inside of the refrigerator separately from the shaft; an up and down moving roller provided on one side of the shelf and guided in the sliding guide; and an operating lever hinged to the shelf and selectively restricting the up and down movement of the shelf by hooking on the shaft when rotating in one direction by the self-load of the shelf.

An elevation adjustment apparatus of a shelf in a refrigerator according to the present invention comprises: a shelf provided in the inside of the refrigerator; a shaft lengthily provided up and down on the wall of the inside of the refrigerator; and an operating lever having one side rotatably supported to the shelf and hooking on the shaft by means of for rotating in one direction by the self-load of the shelf to support the shelf.

An elevation adjustment apparatus of a shelf in a refrigerator according to the present invention comprises: a shaft provided up and down on the wall of the inside of the refrigerator; a shelf into which the shaft is inserted; and an operating lever rotatably coupled to the shelf and having a through hole into which the shaft is inserted to hook the through hole and the shelf when the shelf is moved downward so that the down movement of the shelf is blocked.

An elevation adjustment apparatus of a shelf in a refrigerator according to the present invention comprises: a shaft provided on the wall of the inside of the refrigerator; a shelf into which the shaft is inserted; and an operating lever whose rear part is hinged to the shelf from the rear of the shaft and front part is inserted with the shaft from the top of the shelf to move the shelf upward and support the shelf at the moved position.

Advantageous Effects

The present invention has advantages that a user can conveniently adjust the elevation of the shelf, the structure is simple not to generate noise, the selected position of the shelf is stably maintained, and the elevation of the shelf can be rapidly and considerably adjusted.

BRIEF DESCRIPTION OF THE DRAWINGS

FIG. 1 is a front view showing an external form of a refrigerator according to the present embodiment;

FIG. 2 is a partial front view showing a shape that a door for a refrigerator adopting an elevation adjustment apparatus for a shelf in a refrigerator according to the present embodiment is opened;

FIG. 3 is an exploded perspective view of an elevation adjustment apparatus of a shelf in a refrigerator according to the present embodiment;

FIG. 4 is a partially enlarged perspective view showing a structure of an engaging apparatus according to the present embodiment;

FIG. 5 is a perspective view showing a shape before the shelf is moved upward in the present embodiment;

FIG. 6 is a schematic view an operation of an engaging apparatus while the shelf is moved upward in the present embodiment;

FIG. 7 is a perspective view showing a shape when the shelf is moved downward in the present embodiment;

FIG. 8 is a schematic view an operation of an engaging apparatus while the shelf is moved downward in the present embodiment;

FIG. 9 is a schematic view showing a constitution of another embodiment of an elevation adjustment apparatus for a shelf in a refrigerator according the present invention; and FIG. 10 is a cross-sectional view of line I-I' of FIG. 9.

BEST MODE FOR CARRYING OUT THE INVENTION

Hereinafter, the preferred embodiments of the present invention will be described in detail. However, the following embodiment describes, by way of example, a bottom freeze type refrigerator where a freezing chamber is positioned at a lower portion of a refrigeration chamber for convenience of explanation. However, the present invention is not limited to the types of the refrigerator, but can be applied to any refrigerator type as well as both of the refrigeration chamber and the freezing chamber.

FIG. 1 shows a front view of an external form of a refrigerator according to the present embodiment and FIG. 2 shows a partial front view of a shape that a door for a refrigerator adopting an elevation adjustment apparatus for a shelf in a refrigerator according to the present embodiment is opened.

Referring to FIGS. 1 and 2, a body of a refrigerator 100 is formed in an approximate rectangular parallelepiped shape. The inside of the body 100 is provided with a refrigeration chamber 120 and a freezing chamber 140 for the refrigeration storage and frozen storage of foods.

The refrigeration chamber 120 and freezing chamber 140 is partitioned by a barrier (not shown) so that they are formed on the upper and lower portions of the refrigerator. Also, the refrigeration chamber 120 and the freezing chamber 140 are provided with a door 122 for the refrigeration chamber and a door 142 for the freezing chamber to selectively shield the refrigeration chamber 120 and the freezing chamber 140.

The door 122 for the refrigeration chamber is provided in a form of a side by side door type door on the left and right thereof, respectively, so that it can be opened by rotating the front surface of the refrigeration chamber 120 to the left and right. The door 142 for the freezing chamber is tilted by a predetermined angle and is then constituted to be opened by being drawn in and out in a drawer type.

Also, the front surface of the door 122 for the refrigeration chamber is further provided components for user convenience such as a home bar or a dispenser. Such components is the same as those of a general refrigerator and the detailed description thereof will be therefore omitted.

Meanwhile, reviewing the inside of the refrigerator with reference to FIG. 2, the inner space of the refrigerator 120 is partitioned by a plurality of drawers 160 and shelves 200 provided in the inside of the inner space, wherein each partitioned space receives foods to be stored in a refrigeration state.

More specifically reviewing this, the lower portion of the refrigeration chamber 120 is provided with the drawer 160. The drawer 160 may be constituted in one compartment or two compartments that are separated left and right to be able to store foods with various sizes and may be constituted to control the internal temperature of the drawer 160 to be conformed to kinds of foods received by controlling the supply quantity of cold air supplied to the inner side of the drawer 160.

And, the upper portion of the drawer 160 is provided the plurality of shelves 200. The shelf partitions the inside of the refrigeration chamber 120 up and down and is provided in plural. The shelf is provided to the left and right of the refrigeration chamber 120, respectively.

Each of the plurality of shelves 200 is constituted to selectively control their elevations according to a simple user operation so that the inner space of the refrigeration chamber 120 can be variously produced.

To this end, the inside of the refrigeration chamber 120 is provided with a shaft 300 and a sliding guide 520 lengthily formed up and down and the shelf 200 is constituted to be moved up and down along the shaft 300 and the sliding guide 520.

FIG. 3 shows an exploded perspective view of an elevation adjustment apparatus of a shelf in a refrigerator according to the present embodiment;

The constitutions of the shelf 200, the shaft 300, and the sliding guide 520 will be described in more detail with reference to FIG. 3.

The shelf 200 is constituted by a shelf plate 220 and a shelf frame 240. The shelf plate 220 forms the upper surface of the shelf 200 so that foods can be safely seated when receiving foods. The shelf plate is formed in a plate shape in an approximate quadrangular shape. Most area of the shelf the is formed of transparent plastic or tempered glass to confirm foods on the lower portion of the shelf 200 and an outer circumference thereof is formed with an edge by means of the plastic material.

The shelf frame 240, which forms the frame of the shelf 200, is constituted to support the shelf plate 220 by inserting the shaft 300 to be described below in detail therein.

In detail, the shelf frame 240 is formed in a quadrangular frame corresponding to the shelf plate 220 by coupling a front end frame 242 and a rear end frame 244 forming the external form of the front end and the rear end to side end frames 246 of the left and right and is formed to safely seat the shelf plate 220 on the upper portion thereof.

The shelf frame 240 is formed of a steel material or a plastic material. When the shelf frame 240 is formed of the steel material, it is formed by an angle with a shape of an approximate "L" letter to easily mount the engaging apparatus 400 and a rolling apparatus 500, or the like to be described below. Of course, the shelf plate 220 and the shelf frame 240 can be formed in a single body. In this case, all of the shelf plate 220 and the shelf frame 240 may be formed of the plastic material.

Meanwhile, the left and right of the inner side of the refrigeration chamber 120 are provided with two shafts 300 in order to support one shelf. The shaft 300 guides the up and down movement of the shelf 200 by penetrating through a predetermined position of the shelf 200 and is formed in an approximate round bar shape. And, the upper end and lower end of the shaft 300 is provided with a bracket 320 to couple the shaft 300 to the rear wall surface of the refrigeration chamber 120 to be spaced from each other.

The shaft 300 is preferably mounted to penetrate through the left and right of the rear end of the shelf 200. In more detail, the shaft is mounted to penetrate through the rear end frame 244 up and down.

The one side of the rear frame 244 and the inner side of the refrigeration chamber 120 corresponding thereto are further provided with the rolling apparatus 500. The rolling apparatus 500 is to smoothly and stably move the shelf 200 when moving the shelf 300 up and down and is constituted by a sliding guide 520 and a roller 540.

The sliding guide 520 is lengthily formed up and down and contacts the roller 540 to guide the smooth movement of the shelf 200. The sliding guide 520 is attached to the left and right of the rear wall surface of the refrigeration chamber 120. At this time, the sliding guide 520 is preferably mounted to position between the shafts 300. The reason is that since the self-load of the shelf 200 is supported by means of the shaft 300, it is preferably for the sliding shelf 300 to be plated at the outermost of the shelf 200 in order to stably supply the left and right ends of the shelf. In detail, the sliding guide 520 is preferably mounted on a position contacting the roller 540 to be described below, the cross section shape of the outer side of the sliding guide 520 is formed in a '>' shape to protrude it outside.

Meanwhile, the rear end of the shelf 200 is provided with the roller 540. The roller 540 contacts the sliding guide 520 to perform the rolling movement. The roller rotates along the sliding guide 520 to assist the smooth movement of the shelf 200.

More specifically describing this, the rollers 540 are mounted on the left and right of the rear surface of the rear end frame 244 of the shelf 200 and is rotatably mounted on the rear end frames 244 constituted by two on the upper and lower, respectively, so that four rollers are mounted. And, the outer circumferential surface of the roller 540 is formed with a roller groove 542 in a '>' shape corresponding to the outer circumferential surface of the sliding guide 520 and the roller groove 542 is contacted and rotated to the outer side surface of the sliding guide 520, a roller 540 is provided by two on the left and right of the rear end frame 244, respectively. The rollers simultaneously contacts the sliding guides 520 so that the shelf 200 can stably be moved up and down without being twisted.

Meanwhile, an engaging apparatus 400 is provided on the rear portion of the shelf 200. The engaging apparatus 400 is to move the shelf 200 to a desired elevation and then engage it. The engaging apparatus is constituted to selectively release the restriction of the shelf 200 only by a simple operation such as a rotation to a predetermined angle as well as to facilitate the up and down movement of the shelf 200.

The operation of the engaging apparatus 400 can be understood by means of an enlarged perspective view of the engaging apparatus of FIG. 4.

FIG. 4 shows a partially enlarged perspective view of a structure of an engaging apparatus according to the present embodiment;

Referring to FIG. 4, the engaging apparatus comprises an operating lever 420 and an elastic member 440. The operating lever 420 can be rotated by the user operation and selectively contacts the shaft 300. When contacting the shaft 300, it is constituted to fix the position of the shelf 200.

The operating lever 420 is constituted by an operating part 422, an engaging part 424, and a rotating part 426 and is formed of a material in a bent plate shape and is formed in an approximate '⊏' shape viewed from the lateral. At this time, the length of the bent upper portion of the operating lever 420 is formed to be longer than that of the bent lower portion thereof and the up and down lengths is formed to be longer than those of the bent upper and lower portions.

The operating part 422 forms the upper portion of the operating lever 420 and is formed with a through hole 423 into which the shaft 300 is inserted. The size of the through hole 423 is formed to be larger than that of the shaft 300 and is formed to selectively contact the inner circumferential surface of the through hole 423 to the outer circumferential surface of the shaft 300 according to the rotation of the operating lever 420. The one end (a right end viewed from FIG. 4) of the operating part 422 can be rotatably coupled to the one side of the shelf 200, more specifically to the one side of the rear end frame 244 by means of the hinge 600. Therefore, the operating lever 420 can be rotated using the one end of the operating part 422 as the rotation axis.

The lower surface of the operating part 422 is further provided with a supporting member 425 formed in an approximate wedge shape. The supporting member 425 contacts the upper end of the elastic member 440 to be described below to stably transfer the elastic force of the elastic member 440 to the operating part 422. As shown, it is constituted to contact the inclined portion to the lower surface of the operating part 422 and contact the horizontal portion thereof to the upper end of the elastic member 440.

The elastic force by means of the restoration of the elastic member 440 always intends to rotate the operating part 422 upward and engages the shelf 200 while the one side of the through hole (see 423 of FIG. 6) formed in the operating part 422 contacts the outer circumferential surface of the shaft 200. Of course, the center of the supporting member 425 may be perforated to be penetrated through by means of the shaft 300. In this case, it is preferable to form the perforated central part to conform to the through hole 423. And, the shaft 300 contacts the inner circumferential surface of the through hole 423 as well as the perforated inner circumferential surface of the supporting member 425 according to the rotation of the operating lever 420 so that the engaging force of the shelf 200 can be more improved. Of course, the supporting member 425 is not mounted to the operating part 422 as a separate member but is integrally formed such as the shape that the supporting member 425 is mounted, making it possible to form the supporting member and the supporting member 425 at a time.

Meanwhile, the one side end (a left end in FIG. 4) opposite to the one end of the hinged operating part 422 is vertically bent downward and is then formed to be extended downward to form the holding part 424. The holding part 424 is pressed by a user in order to rotate the operating lever 420. Therefore, it is preferable that the holding part is extendedly formed to a sufficient length to facilitate the user operation.

Also, the lower end of the holding part 424 is formed with a rotation restricting part 426 formed to be vertically bent to the one side formed with the operating part 422. The rotation restricting part 426 is interfered with the one side of the shaft 300 when rotating the operating lever 420 by means of the external force so that it is not rotated any more. It is preferable that the length of the rotation restricting part is slightly shorter than the extended length of the operating part 422. Therefore, when the operating lever 420 is excessively rotated in a counterclockwise direction based on the FIG. 4, the end of the rotating restricting part 426 is formed to contact to the outer side surface of the shaft 300 so that it may be rotated to a range of a proper angle upon operating the operating lever 420.

Meanwhile, the one side of the operating lever 420 is mounted with the elastic member 440. The elastic member 440 forcibly rotates the operating lever 420. It is preferable that the operating member uses a compressing spring. The elastic member 440 is interposed between the one side of the shelf 200 and the operating lever 420 so that it is constituted to provide the elastic force for rotating the operating lever 420. That is, the elastic member 440 is interposed between the operating part 422 and the rear end frame 244 of the shelf 200 corresponding thereto and is mounted to be penetrated through by the shaft 300 so that the upper surface of the elastic member 440 pushes the lower surface of the operating part 422 in the state where the supporting member 425 is interposed and the lower surface thereof contacts the upper surface of the rear end frame 244. Therefore, the elastic member 440 provides the elastic force to always rotate the action lever 420 in a clockwise direction based on FIG. 4 and in the state where the operating lever 420 is forcibly rotated in a clockwise direction, the through hole 423 of the operating part 422 is inclined so that the inner circumferential surface of the through hole 423 presses the outer circumferential surface of the shaft 300, making it possible to maintain the state where the shelf is engaged. Of course, the self-load of the shelf makes the force allowing the inner circumferential surface of the through hole to press the outer circumferential surface of the shaft 300 more strongly so that the resistance force against the position movement of the shelf becomes larger.

Hereinafter, the operation for adjusting the elevation of the shelf in the refrigerator according to the present invention having the above constitution will be reviewed with reference to the drawings.

FIG. 5 shows a perspective view of a shape before the shelf is moved upward in the present embodiment, FIG. 6 shows a schematic view of an operation of an engaging apparatus while the shelf is moved upward in the present embodiment, FIG. 7 shows a perspective view of a shape when the shelf is moved downward in the present embodiment, and FIG. 8 shows a schematic view of an operation of an engaging apparatus while the shelf is moved downward in the present embodiment.

Referring to FIGS. 5 to 8, the mount position of the shelf 200 is fixed in the state where the external force is applied. This is performed by means of the engaging apparatus 400. The operating lever 420 is always maintained in the state where it is rotated in a counterclockwise direction (viewed from FIG. 6) by means of the elastic restoring force of the elastic member 440 so that the one side of the through hole 423 presses the outer circumferential surface of the shaft 300, thereby engaging it not to be sled downward by means of the self-load of the shelf 200.

Such an operation is likewise applied in the case where foods is safely seated on the upper surface of the shelf 200. In this case, both the weight of the shelf 200 and the weight of foods presses the shelf 200 downward. As the shelf 200 moves downward, the through hole 423 of the operating lever 420 more strongly presses the outer circumferential surface of the shaft 300 so that the shelf 200 may be more strongly engaged not to be sled.

In such a state, in order to widen the space of the lower side of the shelf 200 by moving the shelf 200 in the stopped state upward, a user lifts the shelf 200 up while holding the shelf 200 or both sides of the shelf frame 240. At this time, the restricting force of the engaging apparatus 400 is temporarily released to move the shelf 200 upward. That is, if the shelf 200 or the shelf frame 240 is lifted upward, the operating lever 420 is temporarily and very slightly rotated in a clockwise direction, thereby slightly compressing the elastic member 440. The through hole 423 is separated from the outer circumferential surface of the shaft 300 along the rotation of the operating lever 420. Therefore, the upward movement of the shelf 200 is free according to the removal of the engaging force of the engaging apparatus pressing the shaft 300 and when continuously lifting the shelf 200 upward, the shelf 200 is moved upward along the shaft 300. When this operation applies force in an arrow direction of reference numeral 1 in FIG. 6, it may be appreciated that the engaging apparatus 400 is very slightly rotated in an arrow direction of reference numeral 2.

And, when lifting up the shelf to a desired elevation and then spreading out a hand holding the shelf 200 to remove the external force applied to the shelf 200, the operating lever 420 is back rotated in a counterclockwise direction by means of the restoring force of the elastic member 440 so that the through hole 423 presses the outer circumferential surface of the shaft 300. Also, the weight of the shelf and the weight of foods put on the shelf 200 are added so that the operating lever 420 more strongly presses the shaft 300, making it possible to more stably fix the position of the shelf 200.

Next, in order to increase the space on the shelf 200, the elevation of the shelf 200 must be lowered. To this end, the user operates the engaging apparatus 400 to move the shelf 200 downward. That is, in order to move the shelf 200 downward, the user presses the one sides of the operating part 422 and the holding part 424 to rotate the operating lever 420 in a clockwise direction (viewed from FIG. 8). When the operating lever 420 is rotated in a clockwise direction by pressing the holding part 424, the through hole 423 is separated from the shaft 300 so that the restricting force pressing the shaft 300 is removed and the shelf 200 can be moved downward. Next, when the user presses the holding part 424 to move the shelf 200 downward in the state where the operating lever 420 is rotated, the shelf 200 is moved downward along the shaft 300. At this time, the holding part 424 is restricted not to be rotated beyond the predetermined angle by means of the rotation restricting part 426 of the operating lever 420. This is to prevent the through hole 423 from contacting the shaft 300 again due to the excessive rotation of the operating lever 420. That is, the user presses the holding part to the degree that the rotation restricting part 426 is not contacted to the shaft to adjust the rotation angle of the operating lever 420. The through hole 423 maintains the state where it is not contacted to the shaft 300 by means of the adjustment of the rotation angle of the operating lever 420 so that the movement of the shelf 200 is facilitated. When such an operation applies the force in an arrow direction of reference numeral 1 of FIG. 8, it can be appreciated that the engaging apparatus 400 is rotated in an arrow direction of reference numeral 2 and the shelf is moved in an arrow direction of reference numeral 3.

And, the elastic member 440 is compressed in the state of pressing the holding part 424 and the shelf 200 is moved to a desired position. Thereafter, when taking off the hand pressing the holding part 424 to remove the external force, the operating lever 420 is back rotated in a counterclockwise direction by means of the restoring force of the elastic member 440. When the operating lever 420 is rotated in a counterclockwise direction, the through hole 423 of the operating lever 420 again presses the outer circumferential surface of the shaft 300 so that the position of the shelf 200 can be fixed.

Meanwhile, when moving the shelf 200 upward/downward, the roller 540 mounted to the rear end frame 244 performs the rolling movement along the sliding guide 520 and the shelf 200 can be stably and smoothly moved upward and downward by means of the rolling movement of the roller 540 without an unbalance movement of the left and right/up and down direction of the shelf 200. In particular, the shelf 200 is more stably moved according to the relative movement in the state where the protruding part of the sliding guide 520 is received in a roller groove 542 of the roller 540 and the shelf 200 can be moved up and down by means of the rollers 540 provided by two on the left and right, respectively without being twisted and inclined.

Meanwhile, the elevation adjustment apparatus for the shelf in the refrigerator according to the present invention having the constitution as above may have other many modifications in addition to the preferred embodiment and will be described in detail with reference to the drawings.

FIG. 9 is a schematic view showing a constitution of another embodiment of an elevation adjustment apparatus for a shelf in a refrigerator according the present invention, and FIG. 10 is a cross-sectional view of line I-I' of FIG. 9.

The constitution of another embodiment of an elevation adjustment apparatus for a shelf in a refrigerator according to the present invention is substantially the same as the preferred embodiment described above except for the constitution of the rolling apparatus. Therefore, the description of the same components as the foregoing preferred embodiment will be omitted and only the constitution of the rolling apparatus will be described with reference to the drawings.

The rolling apparatus 500 of the present embodiment comprises a receiving guide 560, a protruding part 580, and a rolling member 582.

In detail, the receiving guide 560 is mounted on one side of the refrigeration chamber 120, more specifically on the left and right of the rear wall surface of the refrigeration chamber 120, respectively, to guide the up and down movement of the protruding part to be described below. The receiving guide 560 is lengthily formed and is mounted on the rear wall surface of the refrigeration chamber 120 corresponding both ends of the shelf 200.

The receiving guide 560 is formed to receive the protruding part 580 and its cross section shape is formed in an approximate '⊏' shape so that it is formed not to easily separate the inserted protruding part 580. The protruding part 580 is formed to be vertically extended to backward from the left and right of the rear surface of the rear end frame 244 and its cross section shape is formed in an approximate '⊢' shape to be inserted into the inner side of the receiving guide 560. And, the left end of the protruding part 580 inserted into the inside of the receiving guide 560 is mounted with a plurality of rolling members 582. When the protruding part 580 is received in the inner side of the receiving guide 560, the rolling member 582, it performs the rolling movement by contacting the inner wall of the receiving guide 560 to smooth the up and down movement of the protruding part 580. Such a rolling member 582 is preferably constituted by a ball bearing or a roller bearing.

In the elevation adjustment apparatus for the shelf in the refrigerator according to the present invention, the action for adjusting the elevation of the shelf 200 is the same as the preferred embodiment described above. However, in the action of the rolling apparatus, the protruding part 580 on both sides of the shelf frame 240 is moved in the state received in the receiving guide 560 so that the separation or flow of the shelf 200 is not caused, thereby stably moving the shelf up and down.

MODE FOR THE INVENTION

The idea of the present invention may further include the following various embodiments in addition to the preferred embodiments as described above.

First, the shaft is illustrated in the round bar, however, is not limited thereto. Accordingly, the shaft may be a shape that its front surface capable of extending the contact surface is widely provided in order to increase the friction force and has a plurality of predetermined small steps so that the end of the operating lever can be hooked.

In the drawings, the through hole is illustrated in a straight type of hole that is entirely unchanged. However, the point contacting the through hole to the round bar in the state where the shelf is stopped by means of the engaging apparatus is sharp. That is, the upper end of the through hole is sharp so that the hooking action by means of the contacting portion of the the through hole and the round bar is strong, making it possible to make the magnitude of the stopping force by means of the inner surface of the through hole more larger.

The preferred embodiment of the present invention describes that the engaging apparatus is provided by one on the left and right of the shelf but is not limited thereto. Accordingly, more than three or four engaging apparatus may be provided. Furthermore, the one engaging apparatus is provided on the middle portion of the shelf and the sliding guide is provided on both sides of the shelf, making it possible to stable the up and down movement and stably maintain the engaging action.

The preferred embodiment of the present invention describes that the shelf itself is inserted in the round bar to guide its position and the engaging apparatus contacts the round bar to support the shelf, however, is not limited thereto. Accordingly, the shelf guides the movement upward and downward movement by means of a separate structure and the constitution generating only the action contacting the round bar can be made.

The preferred embodiment of the present invention describes that the operating lever and the shelf are hinged on the rear of the shaft and the operating lever provides the stopping force of the engaging apparatus by the force rotating in a counter-clockwise direction based on FIG. 4. However, the present invention is not limited thereto and can obtain a similar engaging action even in the case where the operating lever and the shelf are hinged in the front of the shaft. However, since this case requires a space to some degree in the rear of the shelf, it is poor economy. Of course, it may be positioned on the side in some cases. However, the operating lever and the shaft are hooked by means of the self-load of the shelf.

INDUSTRIAL APPLICABILITY

The present invention has the following effect.

First, the shelf is constituted to temporarily remove the restriction of the operating lever and the shaft upon moving the shelf upward and can be moved only by lifting the shelf up without a separate work for moving the shelf upward and after the movement of the shelf is completed, the position of the shelf is automatically fixed by means of the restoring force of the elastic member, so that the present invention is easy to use. And, when the holding part of the operating lever is pressed upon moving the shelf downward, it is separated from the shaft by means of the rotation of the operating lever to remove the restricting force and the shelf is automatically moved downward by means of the self-load of the shelf and foods received in the shelf. And, when taking off the hand pressing the holding part at a desired position, the position of the shelf is back fixed so that the present invention is easy to use. Therefore, the user can adjust the elevation of the shelf only by a simple operation without a separate operation such as detaching the shelf or continuously rotating the elevation adjustment member, etc., upon adjusting the position of the shelf so the the convenience of use is improved.

Also, the shelf, which is a structure engaged by the contact of the operating lever and the shaft, can be moved to a desired position at a time irrespective of the movement distance of the shelf so that the elevation of the shelf can be rapidly adjusted without exerting a great force, thereby improving the convenience of use.

Also, the elevation of the shelf can be adjusted by means of a simple operation without separating the shelf upon adjusting the elevation of the shelf so that the elevation of the shelf can be adjusted without putting down or moving the foods received in the shelf, thereby maximizing the convenience of use.

Also, the engaging apparatus has no a separate contacting portion upon moving the shelf up and down and the movement of the shelf is guided by means of the rolling movement of the rolling apparatus. Therefore, the noise generated upon moving the shelf up and down can be prevented so that sensibility dissatisfaction of a user is solved.

The invention claimed is:

1. An elevation adjustment apparatus of a shelf in a refrigerator, comprising:

a shelf comprising a shelf frame and a shelf plate supported on an upper side of the shelf frame;

a shaft lengthily provided up and down in an inside of the refrigerator and penetrating through the shelf frame to allow the shelf to move up and down along the shaft;

an operating lever hinged to the shelf and having a through hole through which the shaft penetrates;

an elastic member pushing the operating lever to cause an edge of the through hole to contact the shaft to restrict movement of the shelf; and a wedge shape supporting member provided at a lower surface of the operating lever to stably transfer an elastic force of the elastic member to the operating lever.

2. The apparatus as claimed in claim 1, further comprising another shaft lengthily provided up and down in the inside of the refrigerator and penetrating through the shelf frame to allow the shelf to move up and down along the another shaft, wherein the shaft and the another shaft are provided on left and right sides of the shelf, respectively.

3. The apparatus as claimed in claim 1, wherein the shelf frame comprises a through hole, the shaft penetrating through the through hole of the shelf frame.

4. The apparatus as claimed in claim 3, wherein the operating lever is protruded at an upper portion of the shelf plate in an engaging state.

5. The apparatus as claimed in claim 1, wherein the operating lever has at least one bent portion, a portion of the at least one bent portion defining a rotation limit of the operating lever when the operating lever is rotated by a external force.

6. The apparatus as claimed in claim 1, wherein the elastic member is interposed between the shelf and the operating lever to provide the elastic force for rotating the operating lever.

7. The apparatus as claimed in claim 1, wherein a self-load of the shelf is applied in a direction to cause the edge of the through hole to contact the shaft to restrict movement of the shelf.

8. The apparatus as claimed in claim 1, wherein the operating lever is hinged to the shelf at a location behind the shaft.

9. The apparatus as claimed in claim 1, wherein one side of the shelf is further provided with a rolling apparatus that smoothly performs up and down movement of the shelf.

10. The apparatus as claimed in claim 9, wherein the rolling apparatus is provided on the left and right sides of the shelf, respectively.

11. The apparatus as claimed in claim 9, wherein the rolling apparatus comprises, a sliding guide lengthily formed up and down and mounted on the inside of the refrigerator; and a roller rotatably mounted on one side of the shelf and performing rolling movement against the sliding guide.

12. The apparatus as claimed in claim 11, wherein the roller has a groove in a shape corresponding to an outer circumferential surface of the sliding guide.

13. The apparatus as claimed in claim 9, wherein the rolling apparatus comprises:

a protruding part protrudedly formed from the shelf;

a receiving guide lengthily formed up and down in the inside of the refrigerator and receiving the protruding part; and a rolling member contacting the receiving guide and the protruding part to perform rolling movement.

* * * * *